US008840957B2

(12) United States Patent
Kirste et al.

(10) Patent No.: US 8,840,957 B2
(45) Date of Patent: Sep. 23, 2014

(54) PROCESS FOR HYDROPHOBICALLY COATING A PIPETTE TIP

(71) Applicant: Hamilton Bonaduz AG, Bonaduz (CH)

(72) Inventors: Vinzenz Kirste, Bonaduz (CH); Renato Nay, Masein (CH); Rainer Beckbissinger, Domat/Ems (CH)

(73) Assignee: Hamilton Bonaduz AG, Bonaduz (CH)

( * ) Notice: Subject to any disclaimer, the term of this patent is extended or adjusted under 35 U.S.C. 154(b) by 15 days.

(21) Appl. No.: 13/921,668

(22) Filed: Jun. 19, 2013

(65) Prior Publication Data

US 2013/0280423 A1 Oct. 24, 2013

Related U.S. Application Data

(62) Division of application No. 13/180,874, filed on Jul. 12, 2011.

(30) Foreign Application Priority Data

Jul. 12, 2010 (DE) ..... 10 2010 031 240

(51) Int. Cl.
*B01L 3/02* (2006.01)
*B05D 7/22* (2006.01)

(52) U.S. Cl.
CPC ..... *B01L 3/0275* (2013.01); *B01L 3/021* (2013.01); *B01L 2300/165* (2013.01)
USPC ..... 427/230

(58) Field of Classification Search
CPC ..... B01L 3/00; B01L 3/02; B01L 3/021; B01L 2300/165
USPC ..... 427/230–237, 430.1; 118/DIG. 10–DIG. 13
See application file for complete search history.

(56) References Cited

U.S. PATENT DOCUMENTS

| | | | | |
|---|---|---|---|---|
| 4,461,328 | A | 7/1984 | Kenney | |
| 4,999,164 | A | 3/1991 | Puchinger et al. | |
| 5,156,811 | A | 10/1992 | White | |
| 5,785,926 | A * | 7/1998 | Seubert et al. | 422/518 |
| 5,874,048 | A | 2/1999 | Seto et al. | |
| 6,475,440 | B1 | 11/2002 | Bochkariov | |
| 7,268,179 | B2 * | 9/2007 | Brown | 524/548 |
| 2009/0220386 | A1 | 9/2009 | Ferri | |

FOREIGN PATENT DOCUMENTS

| | | | |
|---|---|---|---|
| EP | 0 339 622 | A2 | 2/1989 |
| EP | 0 423 719 | A2 | 4/1991 |
| EP | 0 733 404 | A1 | 9/1996 |
| EP | 2 105 203 | A1 | 9/2009 |
| WO | 94/11108 | A1 | 5/1994 |
| WO | 94/25161 | A1 | 11/1994 |
| WO | 01/73396 | A1 | 10/2001 |
| WO | 03/013731 | A1 | 2/2003 |

* cited by examiner

*Primary Examiner* — William Phillip Fletcher, III
(74) *Attorney, Agent, or Firm* — Rothwell, Figg, Ernst & Manbeck, P.C.

(57) ABSTRACT

A process for hydrophobically coating a pipette tip by wetting at least regions of the inside of the pipette tip with a wetting solution, the process including: providing a holding cavity other than the pipette tip on a pipette device, immersing the holding cavity in the wetting solution, aspirating wetting solution into the holding cavity, connecting the pipette tip to the holding cavity, dispensing the aspirated wetting solution from the holding cavity through the pipette tip so as to rinse a pipetting fluid holding chamber portion inside the pipette tip, and evaporating solvent contained in the wetting solution.

19 Claims, 2 Drawing Sheets

PROCESS FOR HYDROPHOBICALLY COATING A PIPETTE TIP

Figure 1:
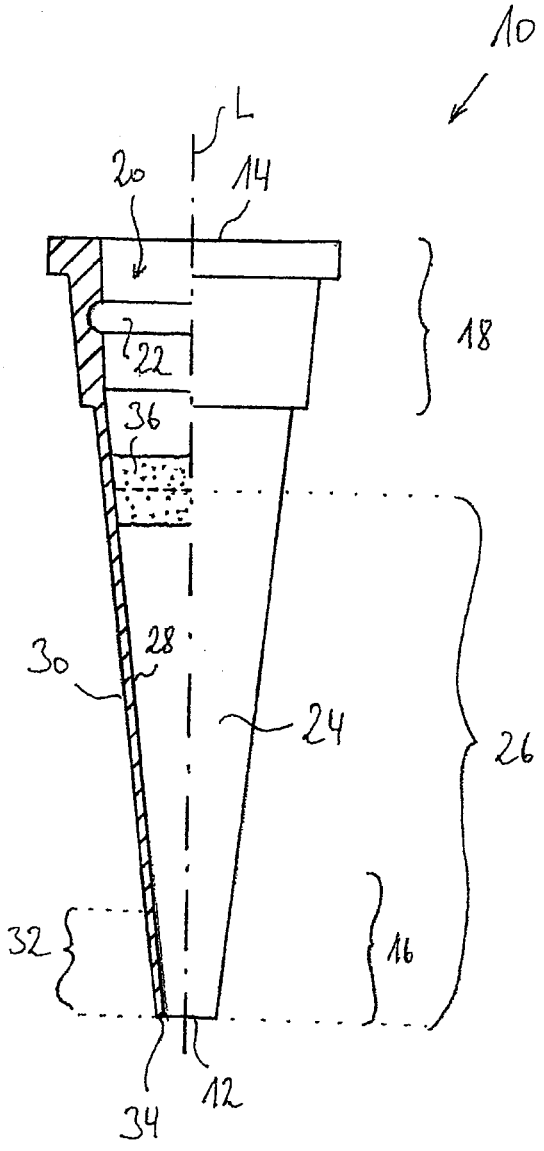

This application is divisional of U.S. Ser. No. 13/180,874, filed Jul. 12, 2011, which claims the benefit of German Patent Application No. 10 2010 031 240.1 filed on Jul. 12, 2010, the disclosures of which are incorporated herein in their entirety by reference.

DESCRIPTION

The present invention relates to a pipette tip, for aspirating and dispensing pipetting fluid, which extends along a pipette tip longitudinal axis, a first axial longitudinal end region of the pipette tip, as a pipetting longitudinal end region, comprising a pipette opening, through which pipetting fluid can flow in the course of operation, and a second axial longitudinal end region of the pipette tip, as a coupling longitudinal end region, which opposes the pipetting longitudinal end region in the axial direction, comprising a coupling shape, for coupling, preferably releasable coupling, to a coupling counter shape of a pipette device, the pipette tip comprising an outer hydrophobic region on the outside thereof and an inner hydrophobic region on the inside thereof, each having a quadratic roughness in a range of 100 nm to 1000 nm, preferably of 150 nm to 750 nm and particularly preferably of 200 nm to 500 nm, and having a peak-to-peak roughness in a range of 800 nm to 5500 nm, preferably of 1750 nm to 4500 nm and particularly preferably of 2500 nm to 3700 nm.

Pipette tips of this type are for example known from WO 03/013731 A. The aforementioned roughness ranges provide the hydrophobic texture of surfaces by exploiting what is known as the "lotus effect", which is also observed on lotus blossoms.

In this context, it is known that surfaces having the aforementioned roughness are far more difficult for liquids to wet than smoother surfaces of the same material.

The hydrophobic texture of surfaces of pipette tips facilitates the complete emptying of the pipette tip and thus increases the accuracy of the amounts of liquid dispensed. Furthermore, a hydrophobic texture of surfaces of pipette tips also reduces the risk of undesired contamination of pipetting fluids in the case of multiple use of a pipette tip. This problem is also referred to in the literature as "cross-contamination". It results from a residue of a first pipetting fluid, from a preceding pipetting process, continuing to adhere as a wetting droplet to a surface of the pipette tip, and thus being able to end up in a subsequently pipetted second pipetting fluid.

For hydrophobically texturing a pipette tip, WO 03/013731 A1 discloses a process which initially provides a polymer surface on the pipette tip. This may be achieved in that the pipette tip is made of an appropriate polymer or in that a pipette tip is coated by immersion in an appropriate polymer melt.

Subsequently, the polymer surface is etched with a solvent which comprises undissolved particles, at least some of which are securely bonded to the polymer surface after the solvent is removed. For this purpose, the particles are present in dispersed or suspended form in the solvent at the start of the process.

This process is obviously complex and, as a result, is of limited reliability, since the bonding of particles dispersed or suspended in the solvent onto the etched polymer surface of the pipette tip is predictable only to a limited extent.

The object of the present invention is therefore to improve the pipette tip known from the prior art and the process for hydrophobically texturing the surface thereof known from the prior art.

This object is achieved for the product, i.e. the pipette tip, by a pipette tip of the type stated at the outset in which the axial extension range of the outer hydrophobic region and the axial extension range of the inner hydrophobic region differ from one another.

In other words, with respect to the pipette tip longitudinal axis, the axial longitudinal extent of the hydrophobically textured surface region on the outside of the pipette tip differs from the axial extent of the hydrophobically textured surface region on the inside of the pipette tip.

Thus, the tip can be and needs to be hydrophobically textured only in those regions in which texturing of this type is actually required.

Within the meaning of the present application, the inside of the pipette tip is the side of which the surface has a normal vector having an extension component towards the imaginary pipette tip longitudinal axis. Accordingly, the outside is the side of which the surface has a normal vector having an extension component away from the pipette tip longitudinal axis.

When the normal vector starting point is moved along a line of intersection between the pipette tip surface and a plane containing the pipette tip longitudinal axis, the regions in which the normal vector changes from having an extension component towards the pipette tip longitudinal axis into having an extension component away from the pipette tip longitudinal axis form the boundaries between the inside and outside of the pipette tip. A boundary of this type generally forms the edge of the pipette opening.

Since, as stated at the outset, the hydrophobic texture of a surface of the pipette tip promotes complete emptying of the pipette tip during dispensing, it is advantageous for the outer hydrophobic region and the inner hydrophobic region each to extend a different distance proceeding from an edge of the pipette opening in the axial direction. In this way, it can be ensured that the edge of the pipette opening, through which the pipetting fluid is to pass during dispensing, is given a hydrophobic texturing.

In most cases, the depth to which the pipette tip is immersed in a pipetting fluid reservoir during aspiration is less, in some cases even considerably less, than the height to which pipette fluid is sucked into the pipette fluid holding space of the pipette tip defined by the inside of the pipette tip. This can be taken into account by providing that the end of the inner hydrophobic region positioned axially further away from the pipette opening is positioned further away from the pipette opening than the end of the outer hydrophobic region positioned axially further away from the pipette opening. To ensure that surfaces of the pipette tip which are to be wetted by the pipette fluid are hydrophobically textured, it is thus sufficient, in most cases of pipetting, to provide hydrophobic texturing of the surface on the outside of the pipette tip merely over a shorter axial extension length, proceeding from the edge of the pipette opening, than on the inside of this pipette tip.

Although it should not be excluded that the outer hydrophobic region and the inner hydrophobic region may be provided separately from one another; nevertheless, to promote emptying of the pipette tip which is as complete as possible during dispensing, it is preferred that the edge of the pipette opening is hydrophobically textured. Since a drop of pipetting fluid which wets the pipette tip surface extends over a larger or smaller wetting patch on the pipette tip surface depending on wetting properties, to promote emptying of the pipette tip which is as complete as possible it is particularly preferred to provide that the outer hydrophobic region and the inner hydrophobic region form a contiguous hydrophobic region over an edge of the pipette opening which defines a boundary between the outside and the inside of the pipette tip.

Since the hydrophobic texturing according to the present invention is based on providing a roughness, as defined at the outset, of the appropriate surface regions, the desired surface roughness can be provided in pipette tips produced by injection moulding by way of a corresponding roughness of the mould cavity surfaces which produce the surface regions.

Alternatively, according to a development of the present invention the pipette tip may comprise, in at least one hydrophobic region out of the inner hydrophobic region and the outer hydrophobic region, a coating which is more strongly hydrophobic than the material of the uncoated pipette tip.

Providing a more strongly hydrophobic coating of this type is explained further below in connection with the process aspect of the present invention. However, the coating leads to a desired roughness of the surface.

Although it is not absolutely necessary for carrying out the present invention, most pipette tips are formed for releasable coupling to a pipette device.

The pipette device comprises a pipette duct, in which the negative and/or positive pressure required for aspirating and dispensing pipetting fluid into and out of a pipette tip is generated and/or provided.

To prevent undesired aerosol soiling of the pipette duct of the pipette device, it is known to provide pipette tips with a filter. A solution of this type is known for example from US 2009/220386 A1.

Aerosol soiling results from evaporated or atomised portions of a liquid aspirated into the pipette tip being sucked in from the pipetting fluid into the respectively coupled pipette duct.

During subsequent pipetting processes, the evaporated or atomised pipetting liquid may then undesirably travel from the pipette duct back into the pipetting fluid holding space of a pipette tip and contaminate pipette fluid held there. This may take place as a result of the described soiling mechanism, involving the pipette device which is separate from the pipette tip, even when disposable pipette tips are used just once on one and the same pipette device.

So as not to reduce the volume of the pipetting fluid holding space of a pipette tip unduly by installing a filter in the inner region of the pipette tip, the filter is preferably provided closer to the coupling longitudinal end region than to the pipetting longitudinal end region of the pipette tip.

The filter is preferably produced from porous, gas-permeable material, such as a sintered plastics material or a fibre tangle or a combination of materials of this type.

Conventional filters operate in such a way that the pores thereof, which are gas-permeable when dry, are sealed when moisture passes through, either by moisture-induced swelling of filter material or by droplet precipitation in the pores, and the filter thus becomes gas-impermeable. In fact, in terms of its operating mechanisms, a filter of this type is better described as a gas flow valve which is gas-permeable or gas-impermeable depending on the gas humidity.

In this context, it has surprisingly been found that, when dry, gas-permeable filters prevent undesirable moisture penetration considerably more effectively if they are hydrophobically textured at least in part on the porous surface thereof. For reasons of simple production, this may particularly advantageously be carried out by providing a coating which is more strongly hydrophobic than the uncoated material of the filter in at least a portion of the filter.

The improved functionality of a filter coated with a more strongly hydrophobic material is possibly due to the following effect:

The increase in surface roughness considerably reduces the wettability of the filter material and thus also of the porous wall of the filter in the coated region, and this leads to a rise in the wetting angles which can be measured between the filter material and a droplet adhering thereto. For a constant amount of liquid, one and the same droplet adhering to the filter material projects further therefrom as the wetting angle increases, in such a way that with an increasingly hydrophobic coating of the filter material, a smaller amount of liquid is sufficient to make the filter virtually gas-impermeable by constricting the flow paths.

The Applicant reserves the right also to seek separate protection for the aspect of a filter which is hydrophobically textured at least in part and in particular coated, independently of hydrophobic texturing of regions of the pipette tip holding the filter.

A filter of this type which is hydrophobically textured at least in part may thus also be provided in a pipette tip which is not hydrophobically textured or which is hydrophobically textured only on the inside or only on the outside or as disclosed above.

So as to prevent gas permeation as quickly as possible, when installed in the pipette tip the filter is preferably provided, at least in the end region facing the pipette opening, with a coating which is more strongly hydrophobic than the material of the uncoated filter.

However, to increase the effect of the filter it is particularly preferred to texture the filter hydrophobically in its entirety, in particular with the aforementioned hydrophobic coating.

As regards construction, the pipette tip described above may preferably be produced in that the uncoated pipette tip comprises a plastics material at least on the outside and/or on the inside thereof. For production of the pipette tips which is as simple and cost-effective as possible, it is preferred for the pipette tip to comprise a uniform plastics material over the entire thickness thereof, and preferably to be formed of the plastics material.

It has been found that a polymer or a copolymer, such as polypropylene and/or polyethylene, is expedient as a plastics material, as is polyamide. These materials are already liquid-repellent at the surface by virtue of the material properties thereof. Blends of these plastics materials may also be used.

To provide easy handling, the hydrophobic coating comprises a plastics material which is preferably compatible with the plastics material of the pipette tip for easier connection thereto. Particularly preferably, the pipette tip and the hydrophobic coating comprise the same plastics material.

In test operation, a pipette tip which when uncoated comprises polypropylene at least on the region thereof intended for hydrophobic coating and is preferably formed of polypropylene and in which the hydrophobic coating comprises a polypropylene-polyethylene copolymer has been found to be particularly advantageous.

According to a process aspect of the present invention, the object mentioned at the outset is also solved by a process for hydrophobically coating pipette tips, which comprises wetting at least regions of the outside and inside of the pipette tip with a wetting solution.

More precisely, the process according to the invention comprises a step of coupling the pipette tip to a fluid pressure source having variable fluid pressure. This means a fluid pressure which provides that pipette fluid is drawn in and expelled, i.e. a pressure of a working fluid other than the pipetting fluid, generally a gas, in particular air.

The process according to the invention further comprises immersing the coupled pipette tip in the wetting solution, making it possible to wet the outside of the pipette tip as a function of the immersion depth by simple means.

The process according to the invention further comprises the step of aspirating wetting solution into the pipette tip, whereby the inside of the pipette tip can be wetted with wetting solution and thus provided with a hydrophobic coating. Once the process is complete, the regions of the pipette tip wetted with wetting solution form the hydrophobically coated regions of the pipette tip.

The process according to the invention further comprises dispensing the aspirated wetting solution in such a way that the pipette tip can be freed again after wetting.

Finally, the process according to the invention further comprises the step of evaporating solvent contained in the wetting solution, resulting in the regions of the pipette tip which are wetted with wetting solution being dried to form a hydrophobic coating.

Once the solvent contained in the wetting solution has completely evaporated, the coating of the pipette tip provided with hydrophobic coating is generally finished.

The advantage of this process according to the invention is that it can also be applied in completely conventional pipette operation, i.e. if necessary it can also be used by the customer to coat finished, delivered pipette tips without the customer requiring special technical devices for this purpose.

If, as stated at the outset, the outer hydrophobic region is not to extend as far in the axial direction from the pipette opening of the pipette tip as the inner hydrophobic region, it may be provided, according to a development of the process according to the invention, that the height of the aspirated wetting solution column in the pipette tip is different from, and preferably exceeds, the immersion depth of the pipette tip in the wetting solution.

In a second process aspect of the present invention, the object set at the outset is also solved by a process for hydrophobically coating pipette tips which comprises wetting at least regions of the inside of the pipette tip with a wetting solution. More precisely, in this case the process comprises the steps of:

- providing a holding cavity other than the pipette tip, preferably a tube member, particularly preferably a glass tube member, on a pipette device,
- immersing the holding cavity in the wetting solution,
- aspirating wetting solution into the holding cavity,
- connecting the pipette tip to the holding cavity,
- dispensing the aspirated wetting solution from the holding cavity through the pipette tip and thus rinsing a pipetting fluid holding chamber portion inside the pipette tip,
- evaporating solvent contained in the wetting solution.

In this case, the holding cavity may preferably be provided by coupling a holding cavity of this type to a pipette device. A tube member, in particular a glass tube member having a smaller diameter than at least the part of the pipette tip closer to the coupling longitudinal end region, is preferably used as a holding cavity, in such a way that the holding cavity can be introduced into the pipette tip from a coupling longitudinal end thereof.

Immersing the holding cavity in the wetting solution prevents the outside of the pipette tip from being wetted by wetting solution. The outer hydrophobic region may thus have an axial extent of zero in this case.

The pipette tip may be connected to the holding cavity in any desired manner, preferably in such a way that the pipette tip, from the longitudinal end thereof on the coupling side, encloses the holding cavity, in such a way that when the wetting solution is dispensed from the holding cavity, an internal region of the pipette tip is rinsed with wetting solution.

For example, the pipette tip may be connected to the holding cavity directly by mounting the pipette tip on the holding cavity.

Equally, the pipette tip may be connected to the holding cavity indirectly via the common pipette device, in such a way that the pipette tip and the holding cavity are connected to the same fluid pressure source.

A pipette device and a prepared reservoir of wetting solution are sufficient for this method too. The pipette device may have to be modified slightly for coupling to the holding cavity, but this is not absolutely necessary in order to use the presently described invention.

The solvent may advantageously be evaporated thermally and/or convectively, for example in that the evaporating step comprises heating the pipette tip and/or passing a fluid through the pipette tip, preferably a gas, particularly preferably air, in particular dry air.

In tests, coating has been particularly successful when the method comprises preparing the wetting solution at a temperature in a range of 65° C. to 85° C., preferably in a range of 70° C. to 80° C., particularly preferably at approximately 75° C. The wetting solution preferably comprises a polymer or copolymer, particularly preferably a polypropylene-polyethylene copolymer, and a solvent which dissolves the polymer or copolymer contained therein. Xylol-based solvents in particular have been found to be advantageous as solvents. A coating obtained in this manner produces a surface roughness in the aforementioned range.

In the second process aspect of the present connection using the holding cavity, particularly good coating results have been achieved when the wetting solution is dispensed through the pipette tip at a flow rate of 0.3 ml/s to 0.7 ml/s, preferably of 0.4 ml/s to 0.6 ml/s, and/or when the wetting solution is dispensed through the pipette tip at a temperature of 20° C. to 30° C., preferably of 21° C. to 25° C., particularly preferably of 22° C. to 25° C.

Figure 2:
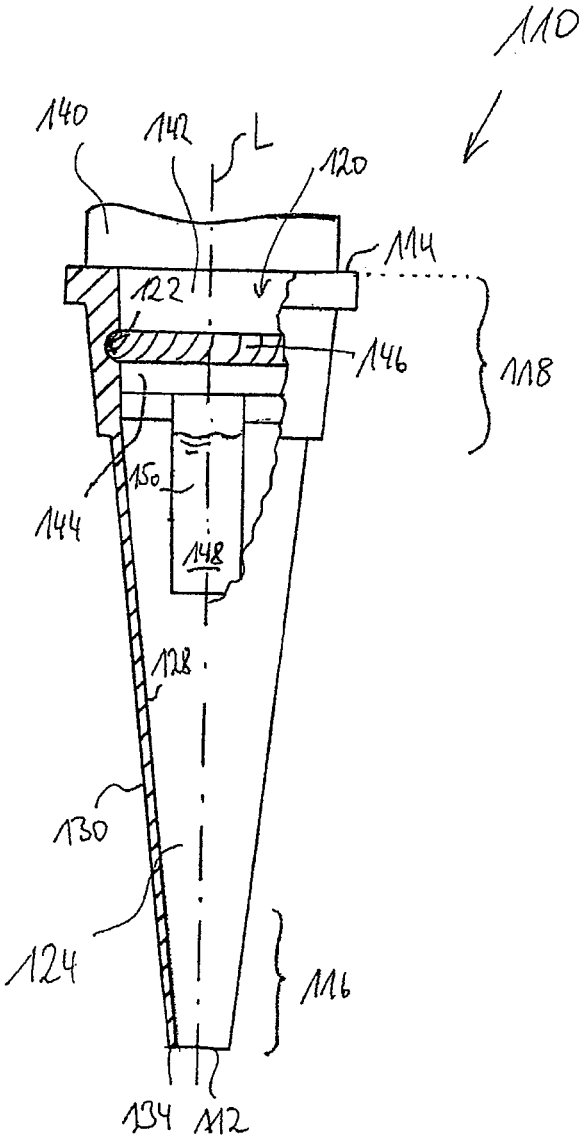

In the following, the invention is described in greater detail by way of the appended drawings, in which:

FIG. 1 is a partial longitudinal section of a first embodiment of a pipette tip according to the invention, and FIG. 2 shows a pipette tip directly before the hydrophobic coating of a portion of the inside thereof close to the pipette opening.

In FIG. 1, a pipette tip according to the invention is denoted generally as 10.

The pipette tip 10 extends along a pipette tip longitudinal axis L from a pipette opening 12 to a coupling longitudinal end 14. The pipette tip 10 thus comprises a first pipetting longitudinal end region 16, which comprises the pipette opening 12, and further comprises a second coupling longitudinal end region 18, which comprises the coupling longitudinal end 14.

The coupling longitudinal end region 18 is provided, in a manner known per se, with a coupling internal shape 20 for releasable positive engagement with a coupling counter-shape of a pipette device (see FIG. 2). For this purpose, the coupling internal shape 20 may comprise a groove 22 which extends around the pipette tip longitudinal axis L and in which an elastomer ring (see FIG. 2), which is compressed in the axial direction and thus expanded in the radial direction, can engage positively when the pipette tip 10 is coupled.

A pipette fluid holding space 24, into which pipette fluid can be aspirated through the pipette opening 12 and out of which pipette fluid can be dispensed again by the same route, is advantageously provided so as to proceed from the coupling internal shape 20 to the pipette opening 12.

The pipette tip 10 shown by way of example in FIG. 1 is preferably injection-moulded from polypropylene, since this material is less wettable than other materials by water, and this facilitates completely emptying the pipette tip 10 in the desired manner when pipetting fluid, generally pipetting liquid, is dispensed.

So as to be able to prevent pipetting fluid residues, which adhere to the pipette tip 10 from previous pipetting processes, from contaminating pipetting fluid, or so as at least to be able to reduce a contamination risk of this type, part of the surface of the pipette tip 10 is hydrophobically textured, in addition to the hydrophobic basic material properties of the polypropylene which is preferably used.

More precisely, a portion of the pipette tip surface of the inside 28 of the pipette tip 10 is hydrophobically textured as an inner hydrophobic region 26, and furthermore, a portion of the surface of the outside 30 of the pipette tip 10 is hydrophobically textured as an outer hydrophobic region 32.

Preferably, the inner hydrophobic region 26 and the outer hydrophobic region 32 are contiguous over the edge 34 of the pipette opening 12, and form a unitary, contiguous hydrophobically textured surface region of the pipette tip 12. This has the advantage that the edge 34 of the pipette opening 12, which is particularly frequently wetted with pipetting fluid, is hydrophobically textured, in such a way that the risk of undesired adhesion of pipette fluid droplets thereto is at least reduced.

Hydrophobic texturing of the surface regions of the pipette tip 10 is achieved by providing a defined roughness, for example by providing a surface having a quadratic roughness in the range of 220 to 300 nm, and having a peak-to-peak roughness in the range of 3000 to 3300 nm.

For this purpose, the outer hydrophobic region 32 of the pipette tip 10 was advantageously initially immersed in a wetting solution comprising a polypropylene-polyethylene copolymer dissolved in a xylol-based solvent, in such a way that the entire outer hydrophobic region 32 was wetted by said wetting solution.

In this state, wetting solution was aspirated into the pipetting fluid holding space 24 until the surface of the inside 28 in the region of the inner hydrophobic region 26 was also wetted with wetting solution.

Subsequently, the pipette tip 10, which was coupled to a pipetting device for the immersion and aspiration process, was removed from the wetting solution, and the aspirated wetting solution was dispensed.

Once the dispensing process was complete, the pipette tip 10, which was wetted by a residual film of wetting solution, was dried convectively in a gas stream.

Advantageously, a coating process of this type can easily be carried out on any desired pipette devices, i.e. even on pipette devices which are already present in laboratories.

The coating of different heights, proceeding from the edge 34 of the pipette opening 12 in the axial direction, on the outside 30 and inside 28 of the pipette tip 10 makes effective use of the wetting solution provided, since said solution is only applied to the pipette tip 10 where it is actually needed in the subsequent pipette operation.

In the example shown in FIG. 1, the axial extension of the inner hydrophobic region 26 is approximately four times the axial extension of the outer hydrophobic region 32. However, this need not be the case. The inner hydrophobic region may also be two, three or five times the axial extension of the outer hydrophobic region or a non-integer multiple thereof.

As can be seen in the example shown in FIG. 1, the pipette tip 10 may comprise, preferably on a region thereof positioned close to the coupling longitudinal end region 18, a filter 36, which reduces the risk of aerosol contamination of the axial space in the pipette tip 10 between said filter and the coupling longitudinal end 14, and thus in particular of aerosol contamination of a pipette device coupled to the pipette tip 10.

The filter 36 may for example be formed of porous material which is gas-permeable when dry, for example of sintered plastics material, in particular sintered polypropylene and/or polyethylene, and/or of a fibre tangle.

To increase its effectiveness, the filter 36 may also, as shown in FIG. 1, be hydrophobically textured at least in part, in this case over approximately half of the axial length thereof, by wetting with the wetting solution described above.

Because of the hydrophobic coating, the filter 36 is advantageously wetted less than if it were uncoated, causing pipetting fluid droplets which precipitate on the filter material to protrude further in the precipitated state from the filter material than if the filter material were uncoated, and this results in the undesired pipetting fluid drops, which precipitate on the filter material, sealing the pores, which provide the gas-permeability of the filter material, more rapidly than in the case of an uncoated filter material, and advantageously preventing pipetting fluid from passing from the pipetting fluid holding space 24 towards the coupling longitudinal end 14 of the pipette tip 10.

It is thus more accurate to refer to the filter 36 as a self-regulating moisture-dependent valve which allows gas through when dry and prevents gas from passing through when moist.

To facilitate the process of decoupling a pipette tip 10 from a pipette device, it is furthermore conceivable also to texture the surface of the annular groove 22 hydrophobically.

The elastomer ring on the pipette device side, which engages in the annular groove 12 when the pipette tip 10 is coupled, can be released from the annular groove 22 more easily, for example because adhesion processes play a lesser role in the case where liquid is present between the annular groove 22 and the elastomer ring.

FIG. 2 shows a situation immediately before coating a region of the internal surface of a pipette tip.

Components or component portions which are the same or have the same function as in FIG. 1 are provided with the same reference numerals, but increased by 100, in the embodiment of FIG. 2.

The embodiment of FIG. 2 will only be described in the following where it differs from that of FIG. 1, and otherwise, reference is expressly made to the description of FIG. 1.

The pipette tip 110 of FIG. 2 corresponds exactly to the pipette tip 10 of FIG. 1 in configuration, except that the pipette tip 110 does not have any hydrophobic coating and no filter is provided.

The pipette tip 110 is shown when coupled to a pipette duct 140.

A conical coupling portion 142 corresponding to the internal coupling shape 120 of the pipette tip 110 can be introduced into the pipette tip 110 from the coupling longitudinal end 114 in the axial direction. A compression cylinder 144 which is axially movable relative to the coupling portion 142 can be displaced axially towards the coupling portion 142 in a manner known per se so as to compress axially, and thus to expand radially, an elastomer ring positioned between the coupling portion 142 and the compression cylinder 144. In this way, the elastomer ring 146 may come into positive engagement with the annular groove 122 when compressed.

In the example shown, a holding cavity 148 in the form of a glass tube, into which wetting solution 150 is aspirated through the pipette duct 40, is accommodated on the pipette duct 140.

The pipette tip 110 encloses the holding cavity 148, in such a way that it is accommodated at least in part in the pipette fluid holding space 124 of the pipette tip 110.

In a subsequent process, the wetting solution 150 is dispensed from the holding cavity 148 by means of overpressure in the pipette duct 140, in such a way as to rinse at least a region of the inside 128 of the pipette tip 110 close to the pipette opening 112. In addition, the wetting solution 150 is driven out of the pipette tip 110 through the pipette opening 112, resulting in a wetted inner hydrophobic portion in the pipette tip 110, wherein the inner hydrophobic portion has a desired roughness, extends a particular distance into the pipette fluid holding space 124 in the axial direction from the edge 134 of the pipette opening 112, and will be finished once it has dried completely.

If the pipette tip 110 is to be hydrophobically textured on the outside 130 thereof, at least in part, at a later point in time, this can be achieved by simply immersing the pipette tip in the appropriate wetting solution and subsequently drying the surface portion of the pipette tip 110 wetted in this manner.

It should be noted that the filter 36 shown in FIG. 1 can be hydrophobically textured in its entirety rather than only in part, preferably by wetting it in its entirety with the appropriate wetting solution.

The invention claimed is:

1. A process for hydrophobically coating a pipette tip by wetting at least regions of the inside of the pipette tip with a wetting solution, the process comprising:

providing a holding cavity other than the pipette tip on a pipette device;

immersing the holding cavity in the wetting solution;

aspirating wetting solution into the holding cavity;

connecting the pipette tip to the holding cavity;

dispensing the aspirated wetting solution from the holding cavity through the pipette tip so as to rinse a pipetting fluid holding chamber portion inside the pipette tip; and evaporating solvent contained in the wetting solution.

2. The process according to claim 1, wherein the evaporating step comprises heating the pipette tip and/or passing a fluid through the pipette tip.

3. The process according to claim 2, wherein the wetting solution is provided at a temperature in a range of 65° C. to 85° C.

4. The process according to claim 3, wherein the wetting solution comprises a polymer and a solvent for dissolving the polymer.

5. The process according to claim 3, wherein the wetting solution comprises a copolymer and a solvent for dissolving the copolymer.

6. The process according to claim 3, wherein the wetting solution comprises a polypropylene-polyethylene copolymer and a solvent for dissolving the copolymer.

7. The process according to claim 3, wherein the wetting solution comprises a polymer and a xylol-based solvent for dissolving the polymer.

8. The process according to claim 2, wherein the wetting solution is provided at a temperature in a range of 70° C. to 80° C.

9. The process according to claim 2, wherein the wetting solution is provided at a temperature of approximately 75° C.

10. The process according to claim 1, wherein the dispensing step comprises dispensing the wetting solution through the pipette tip at a flow rate of 0.3 ml/s to 0.7 ml/s and/or the wetting solution is dispensed through the pipette tip at a temperature of 20° C. to 30° C.

11. The process according to claim 1, wherein the holding cavity other than the pipette tip is a tube member.

12. The process according to claim 1, wherein the holding cavity other than the pipette tip is a glass tube member.

13. The process according to claim 1, wherein the evaporating step comprises heating the pipette tip and/or passing a gas through the pipette tip.

14. The process according to claim 13, wherein the evaporating step comprises heating the pipette tip and/or passing air through the pipette tip.

15. The process according to claim 14, wherein the evaporating step comprises heating the pipette tip and/or passing dry air through the pipette tip.

16. The process according to claim 1, wherein the dispensing step comprises dispensing the wetting solution through the pipette tip at a flow rate of 0.4 ml/s to 0.6 ml/s.

17. The process according to claim 1, wherein the dispensing step comprises dispensing the wetting solution through the pipette tip at a temperature of 20° C. to 30° C.

18. The process according to claim 1, wherein the dispensing step comprises dispensing the wetting solution through the pipette tip at a temperature of 21° C. to 25° C.

19. The process according to claim 1, wherein the dispensing step comprises dispensing the wetting solution through the pipette tip at a temperature of 22° C. to 25° C.

* * * * *